US006089931A

United States Patent [19]

Gorokawa

[11] Patent Number: 6,089,931

[45] Date of Patent: Jul. 18, 2000

[54] TRIM-TILT DEVICE FOR MARINE PROPULSION DEVICE

[75] Inventor: Akira Gorokawa, Saitama, Japan

[73] Assignee: Showa Corporation, Shitama, Japan

[21] Appl. No.: 09/188,763

[22] Filed: Nov. 9, 1998

[30] Foreign Application Priority Data

Mar. 31, 1998 [JP] Japan ..... 10-101891

[51] Int. Cl.[7] ..... B63H 5/125

[52] U.S. Cl. ..... 440/61; 92/143; 92/181 P

[58] Field of Search ..... 440/61; 92/85 R, 92/143, 181 P

[56] References Cited

U.S. PATENT DOCUMENTS 3,799,104 3/1974 Kurling ..... 115/41

4,308,018 12/1981 Nakamura et al. ..... 440/61

4,490,120 12/1984 Hundertmark ..... 440/61

4,687,449 8/1987 Fenrich ..... 440/61

5,261,843 11/1993 Tsujii et al. ..... 440/61

*Primary Examiner*—S. Joseph Morano

*Assistant Examiner*—Ajay Vasudeva

*Attorney, Agent, or Firm*—Orum & Roth

[57] ABSTRACT

A trim-tilt device for a marine propulsion device includes a piston having a valve device for stopping a trim action by bringing a piston-side chamber and a rod-side chamber into communication with each other at an end of a trim region before a propeller of the marine propulsion device rises higher than the surface of the water when the marine propulsion device is generating a propulsive force.

3 Claims, 3 Drawing Sheets

TRIM-TILT DEVICE FOR MARINE PROPULSION DEVICE

BACKGROUND OF THE INVENTION

1. Field of the Invention

The present invention relates to a trim-tilt device for a marine propulsion device for an outboard motor, an inboard motor and the like.

2. Description of the Related Art

There is known in the art a conventional trim-tilt device for a marine propulsion device, which comprises a boat body and a cylinder device interposed between the boat body and the marine propulsion device tiltably supported on the boat body, and in which a hydraulic fluid is controlled for passage from a hydraulic fluid supply-discharge device to the cylinder device and for discharged from the cylinder device to the hydraulic fluid supply-discharge device so that the cylinder device is expanded and contracted to produce a trim action and a tilt action of the marine propulsion device. More specifically, the trim action is for obtaining the best travel state by tilting the marine propulsion device against the propulsive force within a predetermined trim region for trimming up and down so as to adjust the trim of the marine propulsion device. This action requires a relatively large propulsive force of the cylinder device. The tilt action tilts the marine propulsion device at anchor against its gravity within a predetermined tilt up and down region so as to raise the marine propulsion device from the surface of the water. In this case, a relatively small propulsive force of the cylinder device suffices.

There is in the prior art a simple trim-tilt device capable of conducting trim and tilt action using a single hydraulic cylinder as described in Japanese Patent Application Publication (JP-B) No.60-50635.

In the prior art of Japanese Patent Application Publication (JP-B) No.60-50635, although it is unnecessary to provide two cylinders, i.e., a trim cylinder and a tilt cylinder, it is necessary to provide, in a single cylinder, three pistons, i.e., a tilt piston, a free piston and a trim piston and therefore, the structure of the cylinder device is more complicated.

Further, in the marine propulsion device, in order to prevent an engine from being damaged by a propeller which rises higher than the surface of the water and rotates at a higher speed at the time of trim up action of the traveling marine propulsion device, it is necessary to stop the trim action, without fail, at a position before the propeller rises higher than the surface of the water.

SUMMARY OF THE INVENTION

It is an object of the present invention to simplify the structure of the cylinder device in the trim-tilt device for the marine propulsion device, and to prevent the engine from being damaged by limiting the trim action during travel.

According to the present invention, there is provided a trim-tilt device for a marine propulsion device, which comprises a boat body and a cylinder device interposed between the boat body and a marine propulsion device tiltably supported on the boat body, in which a hydraulic fluid is controlled for passage from a hydraulic fluid supply-discharge device to the cylinder device and discharged from the cylinder device to the hydraulic fluid supply-discharge device so that the cylinder device is expanded and contracted to trim and tilt the marine propulsion device. The cylinder device comprises a cylinder connected to one of the boat body and the marine propulsion device, and a piston rod connected to the other of the boat body and the marine propulsion device. An interior of the cylinder is defined into a rod-side chamber and a piston-side chamber by a piston secured to an end of the piston rod, and wherein the piston having a valve device for stopping the trim action by bringing the piston-side chamber and the rod-side chamber into communication with each other at an end of a trim region where by a propeller on the marine propulsion device does not rise upward higher than the surface of the water when the marine propulsion device is generating a propulsive force.

BRIEF DESCRIPTION OF THE DRAWINGS

The present invention will be understood more fully from the detailed description given hereinbelow and from the accompanying drawings of the preferred embodiments of the invention, which are given by way of example only, and are not intended to limit the present invention.

In the drawings.

DESCRIPTION OF THE PREFERRED EMBODIMENTS

Figure 1:
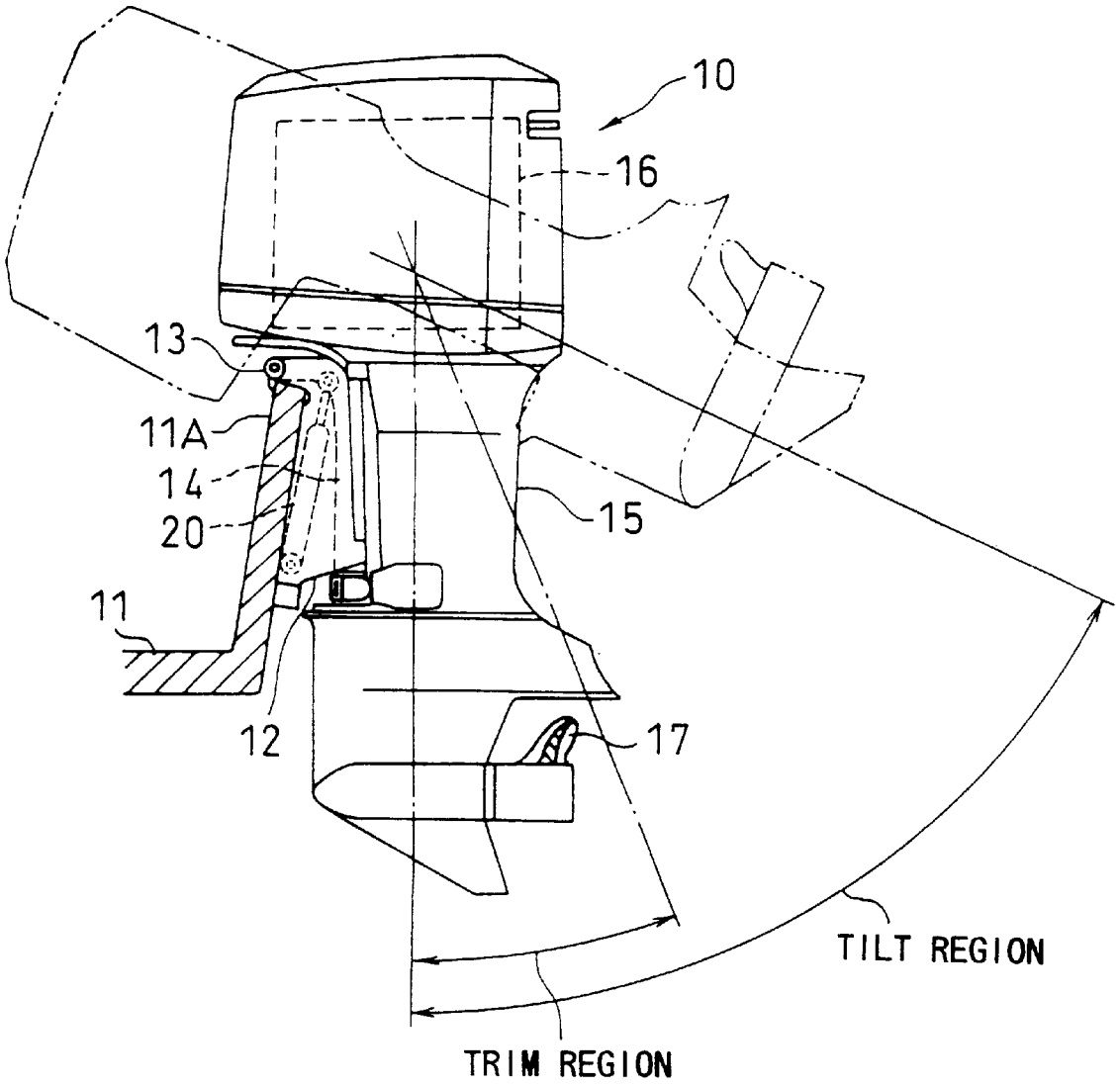
FIG. 1 is a side elevation of a marine propulsion device.
Figure 2:
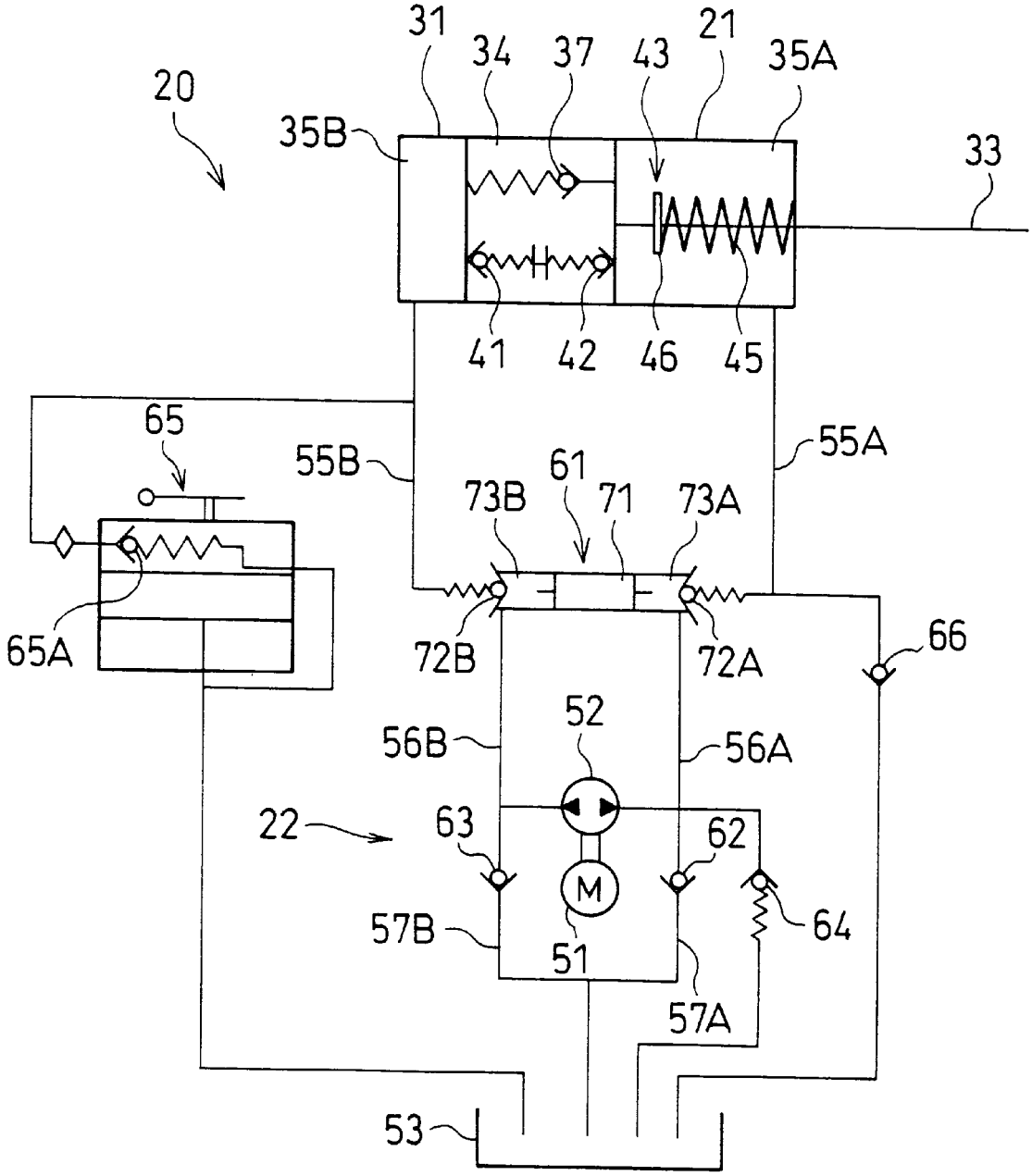
FIG. 2 is a schematic hydraulic circuit diagram showing a trim-tilt device.
Figure 3:
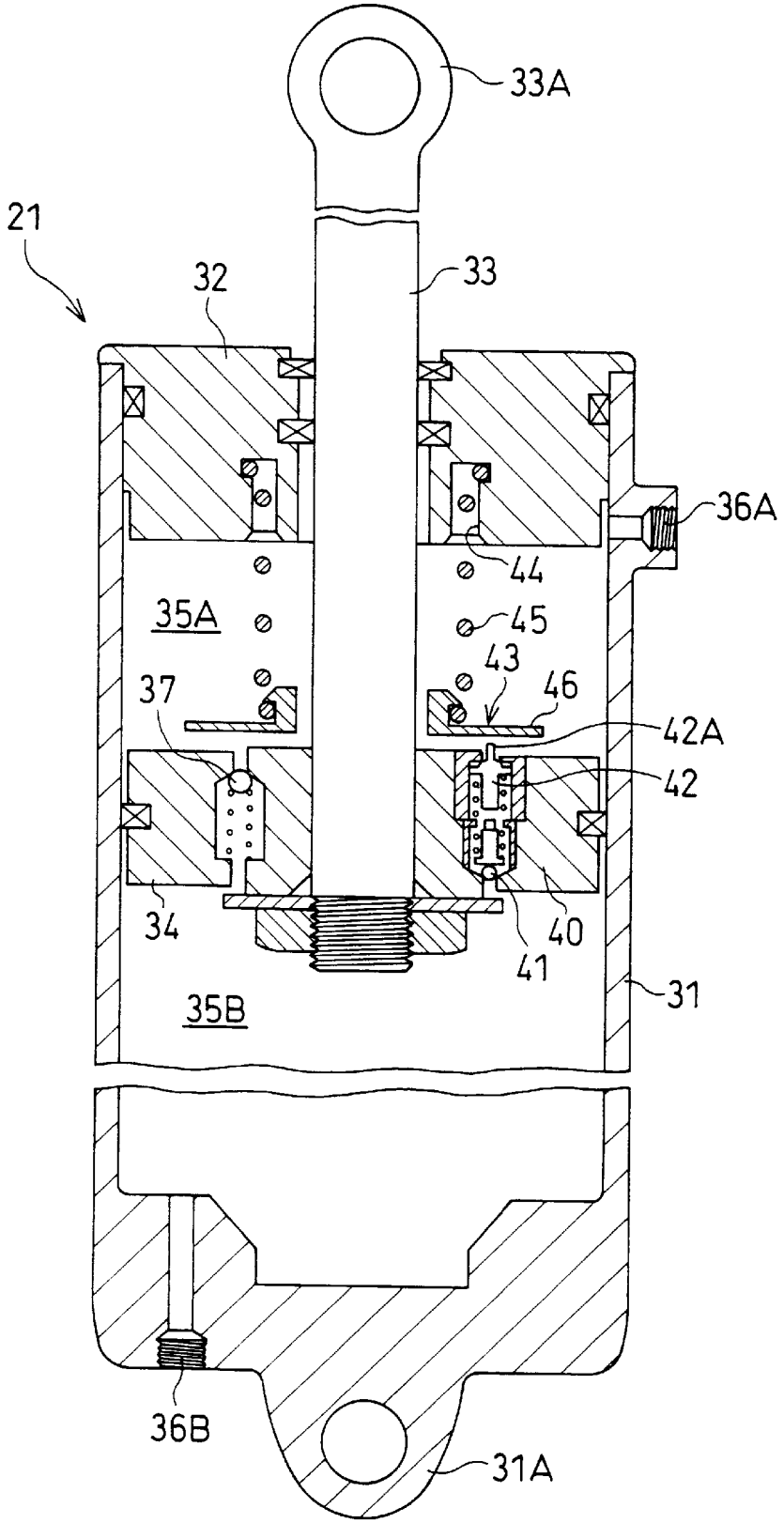
FIG. 3 is a cross-section of a cylinder device.

A marine propulsion device (outboard motor, or inboard motor) 10 is secured at its clamp bracket 12 to a stern plate 11A of a boat body 11. A swivel bracket 14 is pivotally mounted to the clamp bracket 12 through a tilt shaft 13 such that the swivel bracket 14 can tilt around a substantially horizontal axis. A propulsion unit 15 is pivotally mounted to the swivel bracket 14 through a transverse steering shaft (not shown) which is disposed substantially in a vertical direction such that the propulsion unit 15 can turn around the steering shaft. The propulsion unit 15 is provided at its upper portion with an engine unit 16, and at its lower portion with a propeller 17.

The propulsion unit 15 is tiltably supported on the clamp bracket 12 secured to the boat body 11 through the tilt shaft 13 and the swivel bracket 14. A cylinder device 21 of a trim-tilt device 20 is interposed between the clamp bracket 12 and the swivel bracket 14. A hydraulic fluid is controllably supplied from a hydraulic fluid supply-discharge device 22 to the cylinder device 21 and is discharged from the cylinder device 21 to the hydraulic fluid supply-discharge device 22 so that the marine propulsion device 10 expands and contracts cylinder-device 21 for tilting the propulsion unit 15 in a trim region or a tilt region shown in FIG. 1.

(Cylinder Device 21)

The cylinder device 21 of the trim-tilt device 20 comprises a cylinder 31 having a mounting-pin insertion hole 31A which is to be connected to the clamp bracket 12, and a piston rod 33 inserted in the cylinder 31 and supported in a fluid tight manner by a piston rod guide 32 which is provided on the cylinder 31. The piston rod 33 includes a mounting-pin insertion hole 33A which is to be connected to the swivel bracket 14. The inner end of the piston rod 33 is secured to a piston 34. An inner space of the cylinder 31 is defined into a rod-side chamber 35A and a piston-side chamber 35B by the piston 34. The cylinder 31 includes a oil supply-discharge port 36A which is in communication with the rod-side chamber 35A and an oil supply-discharge port 36B which is in communication with the piston-side chamber 35B.

The cylinder device 21 includes a shock blow valve 37. When the propulsion unit 15 collides with submerged driftwood or a log and a shock is applied to the cylinder device 21 in its expansion direction, the shock blow valve 37 opens at a set pressure (e.g., 100±20 kgf/cm$^2$) for protecting the hydraulic circuit so as to transfer the hydraulic fluid in the rod-side chamber 35A into the piston-side chamber 35B to expand the piston rod 33 for turning the propulsion unit 15 upward, thereby absorbing the shock.

In the cylinder device 21, the piston 34 is provided with a valve device 40 which stops the trim action by connecting the piston-side chamber 35B and the rod-side chamber 35A with each other at an end of the trim region before the propeller 17 of the marine propulsion device 10 rises higher than the surface of the water, when the marine propulsion device 10 is generating a propulsive force.

The valve device 40 comprises a relief valve 41 and a pilot valve 42 which are arranged in series within the piston 34.

A set pressure $P_a$ of the relief valve 41. is determined such that the relief valve 41 is opened at a hydraulic pressure $P_1$ in the piston-side chamber 35B during the trim action by the cylinder 21 and is not opened at a hydraulic pressure $P_2$ in the piston-side chamber 35B during the tilt action, i.e., the set pressure $P_a$ is determined to be, e.g., 35 kgf/cm$^2$ ($P_1>P_a>P_2$). The trim action supplies the hydraulic fluid to the piston-side chamber 35B to trim up the propulsion unit 15 in a state where the marine propulsion device 10 is generating a propulsive force, and in which the piston rod 33 is retracted by a counter force of the propulsive force so that the hydraulic pressure $P_1$ in the piston-side chamber 35B is increased. On the other hand, the tilt action supplies the hydraulic fluid to the piston-side chamber 35B such as to tilt up the propulsion unit 15 in a state where the marine propulsion device 10 is not generating the propulsive force and in this case, the hydraulic pressure $P_2$ in the piston-side chamber 35B is smaller than the hydraulic pressure $P_1$ ($P_1>P_2$).

The pilot valve 42 is opened at the end of the trim region before the propeller 17 of the marine propulsion device 10 rises higher than the surface of the water when the piston rod 33 of the cylinder device 21 is expanded such as to trim up the propulsion unit 15. More specifically, an operating device 43 of the pilot valve 42 is provided in the rod-side chamber 35A, and comprises a spring 45 secured to a groove bottom of an accommodation groove 44 provided in the piston rod guide 32, and a plate-like operation element 46 mounted to a tip end of the spring 45. The operation element 46 has a back-up supported in the form of spring 45, and is positioned at a predetermined position in the rod-side chamber 35A. When the piston rod 33 is expanded at the time of trim up of the propulsion unit 15 and the propeller 17 reaches the end of the trim region before the propeller 17 rises higher than the surface of the water, if an operating pin 42A of the pilot valve 42 projecting from an end surface at the side of the rod-side chamber 35A of the piston 34 collides against the operation element 46, since a spring force of the spring 45 supporting the operation element 46 is set greater than a set pressure of the pilot valve 42, the operation element 46 pushes the operating pin 42A to open the pilot valve 42.

In the valve device 40, since the relief valve 41 is opened during the trim action as described above, if the pilot valve 42 is opened at the end of the trim region as described above, the opening states of both the relief valve 41 and the pilot valve 42 bring the piston-side chamber 35B and the rod-side chamber 35A into communication with each other and therefore, the movement of the piston rod 33 is stopped. On the other hand, in the valve device 40, if the relief valve 41 is not opened during the tilt action as described above, even if the pilot valve 42 is opened at the end of the trim region (at the medium portion of the tilt region) as described above, the closing state of the relief valve 41 does not bring the piston-side chamber 35B and the rod-side chamber 35A into communication with each other and therefore, the piston rod 33 is expanded over its entire region of stroke (tilt region). When the valve device 40 expands the piston rod 33 over its entire stroke, the piston 34 keeps compressing the spring 45 through the operation element 46 to push and accommodate the spring 45 into the accommodation groove 44 (the operation element 46 may be accommodated together with the spring 45 into the accommodation groove 44) and therefore, the stroke of the piston rod 33 is not shortened.

An end surface of the piston 34 facing the rod-side chamber 35A is provided with a step in such a manner that an end surface portion of the piston 34 at which valve passages of the shock blow valve 37 and the pilot valve 42 are opened is lower than an end surface portion of the piston 34 against which the operation element 46 pushing the operating pin 42A of the pilot valve 42 abuts. Therefore, when the operation element 46 collides against the operating pin 42A, the operation element 46 does not occlude the openings of the valve passages so that the oil passages can be secured.

Hydraulic Fluid Supply-Discharge Device 22

The hydraulic fluid supply-discharge device 22 comprises a reversible motor 51, a reversible gear pump 52 and a tank 53 so that the hydraulic fluid can be supplied and discharged between the rod-side chamber 35A and the piston-side chamber 35B of the cylinder device 21 through first and second oil passages 55A and 55B.

The hydraulic fluid supply-discharge device 22 further includes a shuttle type switch valve 61, check valves 62, 63, a contraction-side relief valve 64, a manual-thermal valve 65 and a filter valve 66.

The shuttle type switch valve 61 includes a shuttle piston 71, and first and second check valves 72A and 72B disposed on opposite sides of the shuttle piston 71. A first shuttle chamber 73A is defined in the shuttle piston 71 at the side of the first check valve 72A, and a second shuttle chamber 73B is defined in the shuttle piston 71 at the side of the second check valve 72B. The first check valve 72A is opened by a hydraulic pressure applied to the first shuttle chamber 73A by the normal rotation of the pump 52 through a pipe 56A, and the second check valve 72B is opened by a hydraulic pressure applied to the second shuttle chamber 73B by the reverse rotation of the pump 52 through a pipe 56B. The shuttle piston 71 opens the second check valve 72B by a hydraulic pressure by the normal rotation of the pump 52, and opens the first check valve 72A by the hydraulic pressure by the reverse rotation of the pump 52. The first check valve 72A of the shuttle type switch valve 71 is connected to the first oil passage 55A, and the second check valve 72B is connected to the second oil passage 55B.

A check valve 62 is interposed in an intermediate portion of a connection pipe 57A connecting the pump 52 and the tank 53. More specifically, during the trim up and tilt up operations of the marine propulsion device 10, the volume in the cylinder 31 is increased by a volume of the retreated piston rod 33 and an amount of circulating hydraulic fluid is deficient. Therefore, the check valve 62 is opened so that the deficiency can be compensated to the pump 52 from the tank 53.

A check valve 63 is interposed in an intermediate portion of a connection pipe 57B connecting the pump 52 and the tank 53. More specifically, during the trim down and tilt down operations of the marine propulsion device 10, when the piston 34 reaches the maximum contraction position and the trim down and tilt down operations have been completed and there is no hydraulic fluid returning from the piston-side chamber 35B to the pump 52, if the pump 52 is further operated, the check valve 63 is opened so that the hydraulic fluid can be supplied from the tank 53 to the pump 52.

The contraction-side relief valve 64 is connected to the pipe 56A. In order to return to the tank 53, hydraulic fluid for the rod which remains at the time of the trim down and tilt down operations, and in order to protect the hydraulic circuit when the pump 52 is further operated even if the trim down and tilt down operations have been completed, the pressure in the circuit is released to the tank 53 if the pressure reaches a set pressure (e.g., 55 to 77 kgf/cm$^2$).

The manual-thermal valve 65 is connected to the second oil passage 55B, and the cylinder device 21 is manually contracted by connecting the piston-side chamber 35B to the tank 53, so that the propulsion unit 15 can trim down and tilt down. The manual-thermal valve 65 includes a thermal relief valve 65A so that when a pressure in the hydraulic fluid of the cylinder 31 is abnormally increased due to heat, the pressure in the circuit is released to the tank 53 if the pressure reaches a set pressure (e.g., 200 to 250 kgf/cm$^2$).

At the time of tilt up operation, if the pump 52 is further operated even if the piston rod 33 reaches the maximum expansion position and the tilt up has been completed, the hydraulic circuit is protected by releasing the pressure to the tank 53 in the circuit through the relief valve 41 which is opened by the pressure at that time and through the pilot valve 42 which is opened by the operation device 43 at the time of tilt up operation.

The operation of the trim-tilt device 20 will be explained below.

(1) Trim Action

The purpose of trim action is for obtaining the optimal travelling trim by holding the propulsion unit 15 in a relatively moderate tilting state within the trim region when the marine propulsion device 10 is generating the propulsive force.

If the motor 51 and the pump 52 are rotated in reverse to send the hydraulic fluid in the cylinder 31 to the piston-side chamber 35B, since the counter force of the propulsive force of the marine propulsion device 10 compresses the piston rod 33, the hydraulic pressure in the piston-side chamber 35B is increased, the hydraulic pressure $P_1$ exceeds the valve opening pressure $P_a$ to open the relief valve 41. Since the pilot valve 42 is not opened until the propulsion unit 15 reaches the end of the trim region, the piston rod 33 moves in the expansion direction by the hydraulic pressure in the piston-side chamber 35B to trim up the propulsion unit 15 within the trim region. When the propulsion unit 15 is trimmed to a predetermined trim angle and is set to the optimal travel trim, if the motor 51 and the pump 52 are stopped, the piston rod 33 is fixed at its position.

If the propulsion unit 15 is trimmed up and reaches the end of the trim region before the propeller 17 of the marine propulsion device 10 rises higher than the surface of the water, the operation element 46 which is resiliently supported by the spring 45 of the operation device 43 collides against the operating pin 42*a* of the pilot valve 42 to opened the pilot valve 42. With this operation, the relief valve 41 and the pilot valve 42 which are arranged in series in the piston 34 are opened to connect the piston-side chamber 35B and the rod-side chamber 35A with each other. As a result, the hydraulic fluid to be supplied to the piston-side chamber 35B is circulated through the valve device 40 into the rod-side chamber 35A, and the piston rod 33 is stopped.

If the motor 51 and the pump 52 are rotated in normal direction to send the hydraulic fluid in the cylinder 31 to the rod-side chamber 35A in a state where the propulsion unit 15 is trimmed to form a trim angle, the piston rod 33 is moved in the retraction direction by the hydraulic pressure in the rod-side chamber 35A so that the propulsion unit 15 can be trimmed down in the trim region.

(2) Tilt Action

The purpose of tilt action is for tilting up the propulsion unit 15 upward higher than the surface of the water to hold the propulsion unit 15 above the water when the marine propulsion device 10 is not generating the propulsive force.

If the motor 51 and the pump 52 are rotated in reverse and the hydraulic fluid in the cylinder 31 is sent to the piston-side chamber 35B, since the hydraulic pressure $P_2$ in the piston-side chamber 35B is lower than the pressure $P_1$ when the above-described counter force of the propulsive force is acting and lower than the set pressure $P_a$ of the relief valve 41, the relief valve 41 is not opened. However, it is possible to tilt up the weight of the propulsion unit 15 itself, and the piston rod 33 is moved in the expansion direction. When the propulsion unit 15 is tilted to a desired tilt angle, if the motor 51 and the pump 52 are stopped, the piston rod 33 is fixed at its position.

When the propulsion unit 15 is tilted up, and the propulsion unit 15 passes through the trim region, the operation element 46 which is resiliently supported by the spring 45 opens the pilot valve 42 in the piston 34. Even if the pilot valve 42 is opened, the relief valve 41 is not opened as described above and therefore, it is possible to further tilt up the propulsion unit 15. When the piston rod 33 is further expanded beyond the trim region, the spring 25 which is compressed by the piston 34 is engaged in the accommodation groove 44 of the piston rod guide 32.

If the motor 51 and the pump 52 are normally rotated to send hydraulic fluid in the cylinder 31 to the rod-side chamber 35A in a state where the propulsion unit 15 is tilted, the piston rod 33 is moved in the retraction direction by the hydraulic pressure in the rod-side chamber 35A, and the propulsion unit 15 can be tilted down. The hydraulic fluid supplied to the rod-side chamber 35A is not introduced into the piston-side chamber 35B because the relief valve 41 is closed to retract the piston rod 33. irrespective of the opening or closing state of the pilot valve 42.

Therefore, according to the present embodiment, the following effects can be obtained:

(1) At the time of trim action for inclining the marine propulsion device 10 when it is generating the propulsive force, the counter force of the propulsive force generated by the marine propulsion device 10 compresses the piston rod 33 of the cylinder device 21 and as a result, the hydraulic pressure in the piston-side chamber 35B is increased, and this hydraulic pressure exceeds the opening pressure of the relieve valve 41 to open the latter. On the other hand, the pilot valve 42 is opened when the trim action proceeds and the propeller 17 of the marine propulsion device 10 reaches the end of the trim region before the propeller 17 rises higher than the surface of the water. With this operation, both the relief valve 41 and the pilot valve 42 arranged in series in the piston 34 of the valve device 40 are opened at the end of the trim region to bring the piston-side chamber 35B and the rod-side chamber 35A into communication with each other and as a result, the hydraulic fluid to be supplied to the piston-side chamber 35B passes through the valve device 40 and circulates to the rod-side chamber 35A so that the piston rod 33 is stopped. Therefore, when the marine propulsion device 10 is generating the propulsive force, the propeller 17 should not rise higher than the surface of the water even if the trim operation is conducted, so that the engine unit 16 will be prevented from being damaged.

At the time of the tilt action for inclining the marine propulsion device 10 when it is not generating the propulsive force, the hydraulic pressure in the piston-side chamber 35B does not rise and thus this hydraulic pressure should not exceed the opening pressure of the relief valve 41, and the relief valve 41 should not be opened. Therefore, even if the pilot valve 42 is opened at the end of the trim region, the piston-side chamber 35B and the rod-side chamber 35A are not brought into communication with each other because the relief valve 41 is closed. Therefore, the hydraulic fluid to be supplied to the piston-side chamber 35B makes the piston rod 33 expand over the entire region (tilt region) of its stroke.

(2) The operating device 43 of the pilot valve 42 comprises the operation element 46 which is resiliently supported by the piston rod guide 32 of the cylinder, and the operation element 46 opens the pilot valve 42 at the end of the trim region. Therefore, it is possible to limit the trim action with a simple structure.

(3) At least a portion of the operating device 43, e.g., the spring 45 resiliently supporting the operation element 46, can be accommodated in the accommodation groove 44 of the piston rod guide 32. Therefore, at the time of the tilt action, when the piston rod 33 expands over the entire region of its stroke after the operation element 46 which is resiliently supported by the spring 45 opens the pilot valve 42 in the piston 34, the spring 45 is received in the accommodation groove, so that the expansion and contraction stroke of the piston rod 33 is prevented from being shortened due to the existence of the spring 45.

While the preferred embodiments of the invention have been described in detail with reference to the drawings, they are by no means limitative, and various changes and modifications are possible without departing from the scope and spirit of the invention.

As described above, according to the invention, in the trim-tilt device for the marine propulsion device, it is possible to simplify the structure of the cylinder device, and to prevent the engine from being damaged by limiting the trim action during sailing.

Although the invention has been illustrated and described with respect to several exemplary embodiments thereof, it should be understood by those skilled in the art that the foregoing and various other changes, omissions and additions may be made to the present invention without departing from the spirit and scope thereof. Therefore, the present invention should not be understood as limited to the specific embodiment set out above but to include all possible embodiments which can be embodied within a scope encompassed and equivalents thereof with respect to the feature set out in the appended claims.

What is claimed is:

1. A trim-tilt device interposed between a marine propulsion device and a boat body to which the propulsion device is tiltably attached, comprising:

cylinder means adapted to receive fluid from and discharge fluid to a hydraulic fluid supply-discharge device to expand and retract for trim and tilt action of the propulsion device, said cylinder means comprising a cylinder connected to one of said boat body and said propulsion device;

piston in said cylinder, and a piston rod attached to said piston and connected to the other of said boat body and said propulsion device, said piston defining in said cylinder a rod-side chamber and a piston-side chamber;

a valve device on said piston for stopping the trim action by interconnecting said piston-side chamber and said rod-side chamber at an end of a trim region before a propeller of said propulsion device rises higher than the surface of the water when the propulsion device is generating a propulsive force;

wherein said valve device comprises a relief valve which opens by a hydraulic pressure of said piston-side chamber during said trim action and which does not open by a hydraulic pressure of said piston-side chamber during said tilt action and a pilot valve which opens at said end of said trim region where said propeller of said marine propulsion device does not rise upward higher than the surface of the water, said relief valve and said pilot valve being arranged in series.

2. A trim-tilt device according to claim 1, comprising a piston rod guide in said cylinder and wherein an operating device of said pilot valve includes an operation element resiliently supported by said piston rod guide such that said pilot valve is opened at said end of said trim region.

3. A trim-tilt device according to claim 2, wherein at least a portion of said operating device is capable of being received in an accommodating groove formed in said piston rod guide.

* * * * *